United States Patent [19]

Müller et al.

[11] Patent Number: 4,846,417

[45] Date of Patent: Jul. 11, 1989

[54] METHOD OF AND APPARATUS FOR THE FEEDING OF A PAPER WEB TO A ROLL-MAKING MACHINE

[75] Inventors: Georg Müller, Neuss; Gerhard Buschmann, Düsseldorf; Peter Hoffmann, Korschenbroich, all of Fed. Rep. of Germany

[73] Assignee: Jagenberg Aktiengesellschaft, Dusseldorf, Fed. Rep. of Germany

[21] Appl. No.: 173,732

[22] Filed: Mar. 25, 1988

[30] Foreign Application Priority Data

Mar. 31, 1987 [DE] Fed. Rep. of Germany ..... 3710142

[51] Int. Cl.[4] ..... B65H 18/16; B65H 35/02

[52] U.S. Cl. ..... 242/65; 226/92; 242/56.2

[58] Field of Search ..... 242/67.1 R, 56 R, 74, 242/195, 65, 78.3, 66, 56.2; 226/92

[56] References Cited

U.S. PATENT DOCUMENTS

| | | | |
|---|---|---|---|
| 2,862,705 | 12/1985 | Faeber | 226/92 |
| 3,592,403 | 4/1971 | Schmmitt | 245/65 |
| 4,508,283 | 4/1985 | Beisswanger | 242/66 |

FOREIGN PATENT DOCUMENTS

| | | |
|---|---|---|
| DE3102894 | 8/1982 | Fed. Rep. of Germany . |
| DE3117094 | 11/1982 | Fed. Rep. of Germany . |

*Primary Examiner*—Stuart S. Levy
*Assistant Examiner*—J. Eghtessad
*Attorney, Agent, or Firm*—Herbert Dubno

[57] ABSTRACT

To lift the leading end of a paper web upwardly into contact with the underside of a perforated support roll which draws the web by suction thereagainst, a bar, rod or wire forming an entrainer is lifted by a pair of strands controlled by a windlass to engage the entrainer in a crease at the leading end of the web, the entrainer passing over a pressing roller which can be displaced toward the support roller and is retractable therefrom.

13 Claims, 3 Drawing Sheets

METHOD OF AND APPARATUS FOR THE FEEDING OF A PAPER WEB TO A ROLL-MAKING MACHINE

FIELD OF THE INVENTION

Our present invention relates to a method of lifting the leading end of a paper web onto the underside of a roll in a paper-processing machine such as a machine for making rolls from a continuous web arriving at the machine from below. More particularly, the invention relates to a method of and an apparatus for the application of a leading end of a paper web to the underside of a paper-rolling machine roll.

BACKGROUND OF THE INVENTION

Roll-making machines in the paper industry can comprise a support roll which can be perforated and internally subjected to vacuum to hold the paper web against this roll as the paper web is transported to a roll of paper being formed on the support roll at one or more stations.

In general, the paper web is fed from below to the support roll and must be brought into contact with the underside thereof so that it can be entrained by rotation of the support roll to the roll-making station.

Problems are encountered whenever a new paper web must have its leading end fed to the support roll.

Usually the guide path for the paper web lies beneath the floor above which the roll-making elements of the machine are disposed. To feed a new leading end of a paper web, upon replacement of a supply roll or upon tearing of the web, it is usually necessary to manually lift the leading end of the web and place it upon the underside of the support roll in a time-consuming operation.

When the machine is equipped with longitudinal slitters for subdividing the paper web into a plurality of strips, the slitting blades generally engage the web from opposite sides and at least one of these blades can be moved away from the path of the web to permit the leading end of the new web to be fed upwardly from the paper feed path below the floor, through an opening in the floor to meet the underside of the support roll.

Thereafter the paper web is advanced by the support roll which is provided with suction openings and is subjected to subatmospheric pressure as described. A paper roll-making machine having a support roll of this type with feeding of the paper web from below is described in German patent DE-PS 31 02 894.

It is known to facilitate the feed of the web in the region below the support roll from German open application DE-OS 31 17 094. In this system the leading end of the web is fed with the aid of compressed air utilizing a table which can be raised and lowered and serves to guide the web. With this means, the leading end of the web is pressed against the underside of the support roll. This system has not been found to be fully satisfactory.

OBJECTS OF THE INVENTION

It is the principal object of the present invention to provide an improved method of feeding a paper web from below to the underside of a support roll, especially in a roll-making machine in which the support roll then carries the web to the roll-making station.

Another object of the invention is to provide a method which simplifies the feeding of the leading end of the web to a support roll so that time-consuming hand operations are eliminated or reduced in significance.

Another object of our invention is to provide an improved feeder in the leading end of a paper web which at relatively low cost and with a high degree of reliability can be used to effect transport of the paper web from below onto a support roller in a fully automatic manner.

SUMMARY OF THE INVENTION

These objects and others which will become apparent hereinafter are achieved with a method according to the invention which comprises the steps of:

(a) forming a crease in the leading end of the paper web;

(b) engaging an elongated generally horizontal entraining member from below in said crease;

(c) lifting the elongated entraining member with the crease engaged thereby to the underside of the support roll, thereby drawing the leading end of the paper web to the underside of the support roll; and (d) pressing the elongated entraining member and the crease against the support roll with a pressing element by advancing the pressing element, over which the member can be guided, toward the support roll.

In its apparatus aspects the invention comprises:

an elongated generally horizontal entraining member engageable from below in a crease formed in the leading end of the paper web;

means for lifting the elongated entraining member with the crease engaged thereby to the underside of the support roll, thereby drawing the leading end of the paper web to the underside of the support roll; and a pressing element advanceable toward and retractable from the underside of the support roll and positioned for pressing the elongated entraining member and the crease against the support roll upon advancing of the pressing element, over which the member can be guided, toward the support roll.

Specifically, therefore, the invention provides for the folding of a crease which is open downwardly on the leading end of the paper web below the floor of the roll-making machine so that a generally horizontal rod, bar, tube or wire forming the elongated member can be lifted from below into the crease and then, as the web is advanced and the member raised, the leading end lifted by engagement of the member in the crease by a pair of strands which can be wires, cables or cords, upwardly to the underside of the support roll.

The member is drawn over the pressing element which has a compressible surface and can be formed with an elastic cover or bristles or the like, to ensure, as the pressing element rotates freely, that the strands can draw the member and the crease somewhat along the support roll on the pressing roller.

The pressing roller is movable toward and away from the surface of the support roll by a fluid-operated-cylinder arrangement.

The pressing roller can be flanked by a pair of hooks in which the elongated member can be caught as it is retracted by the windlass means and from which the elongated member can be displaced to allow it to be lowered upon reversal in the direction of rotation of the windlass means and from which the elongated member can be displaced to allow it to be lowered upon reversal in the direction of rotation of the windlass means by a camming surface past which the hooks move on retraction. Alternatively the strands may be affixed at their lower ends to a part of the machine so that the strands are guided throughout their paths. A compensating roller may engage in loops of the strands below the elongated member which engages the crease, this compensating roller being urged downwardly by its weight, by a spring force, or the like.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
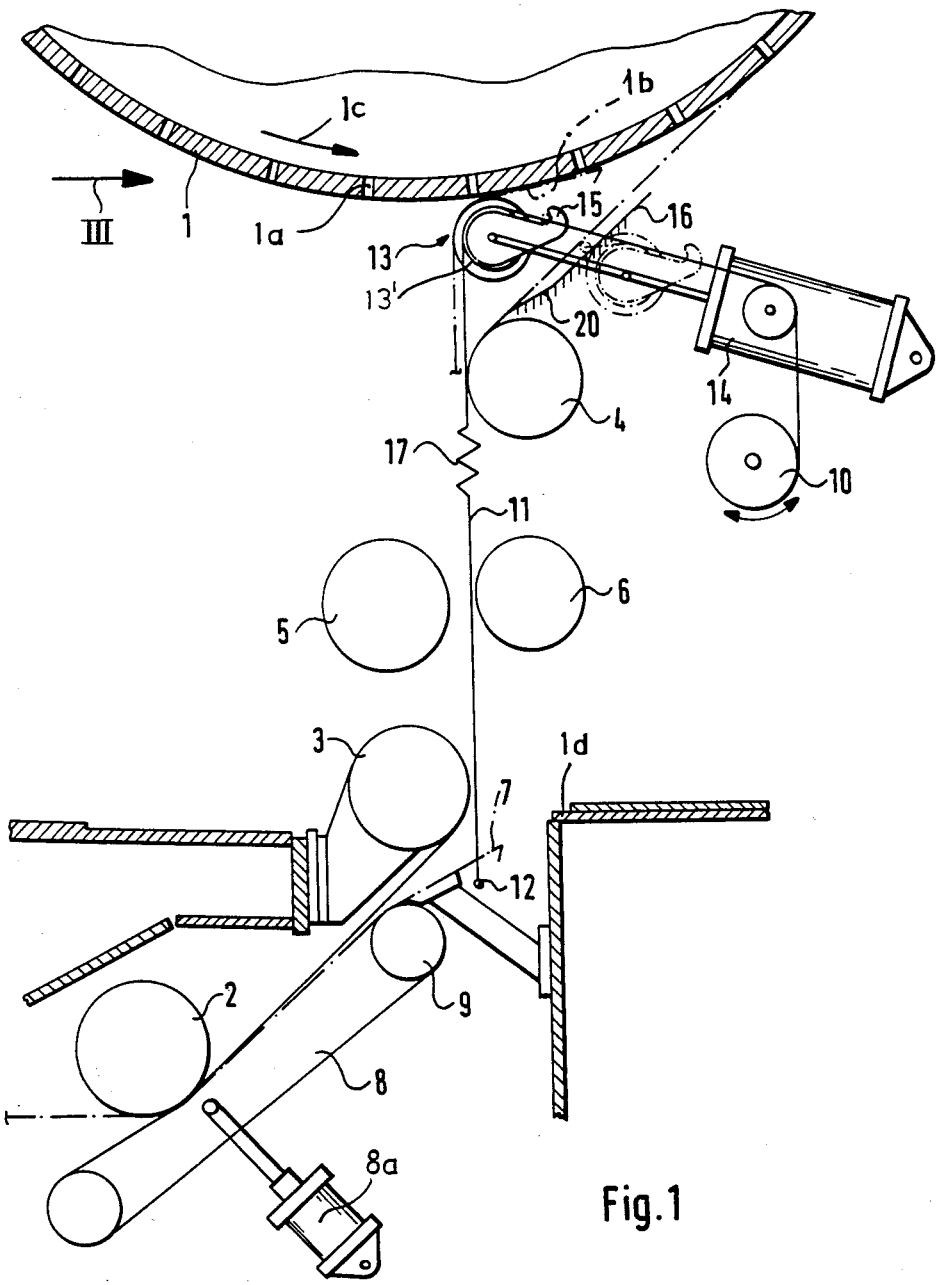
FIG. 1 is a vertical cross sectional view through a portion of a roll-making machine showing the device of the invention in an embodiment in which the elongated member is affixed to free ends of a pair of strands.
Figure 2:
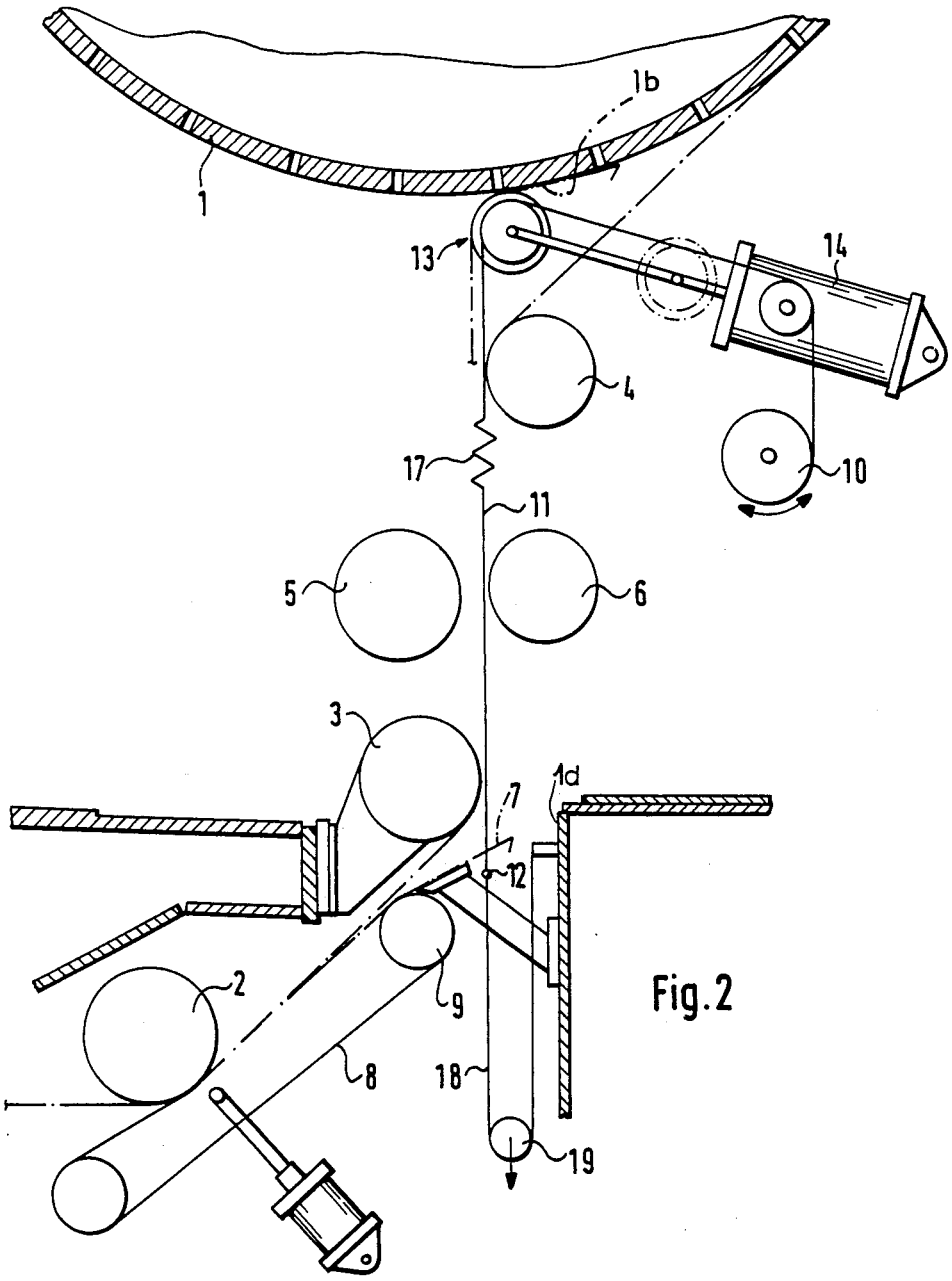
FIG. 2 is a view similar to FIG. 1 illustrating the embodiment in which the lower ends of the strands are looped and provided with a compensating roller.
Figure 3:
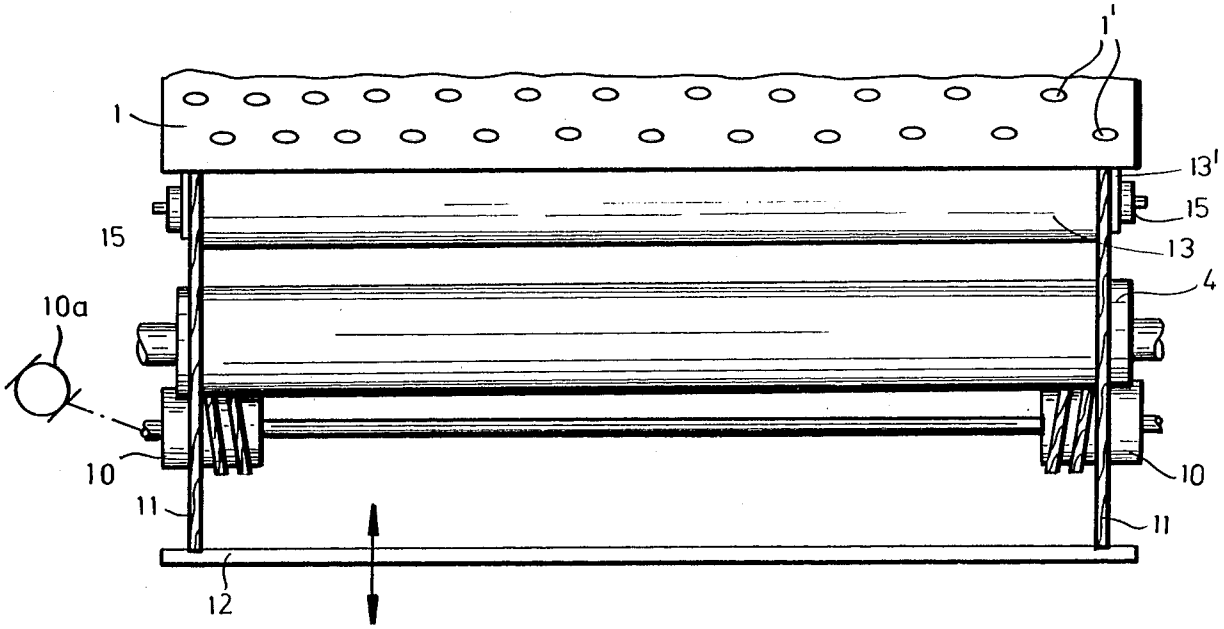
FIG. 3 is a partial elevational view taken generally in the direction of the arrow III in FIG. 1.

The apparatus of FIGS. 1–3 is intended for a roll-making machine in which a roll of the paper web or rolls formed from strips therefrom are coiled on a support roll 1 on an upper part of which the rolls to be coiled can rest.

For this purpose, the paper web must be fed from below to the underside of the support roll 1 which is provided with perforations 1a and internally evacuated to draw the paper web suction as can be seen at 1b against the underside of this roll. Continued rotation of the roll in the direction of arrow 1c will carry the paper web to the roll-making stations.

Below the floor 1d of the paper-making machine and between this floor and the support roll 1, guide rollers 2, 3 and 4 can be provided for the paper web. In addition, a longitudinal slitting arrangement 5, 6 is provided along the vertical stretch of the web to slit the web into a plurality of strips.

One of the blade systems 6 can be movable away from the other blade system 5 to allow the free end of the web to be drawn therebetween.

To feed the leading end 7 of the web to the region directly below the support roll, a web swing 8 can be provided which can rock back and forth under the control of a cylinder 8a, the web swing 8 being provided at its outlet side with a deflection roller 9 shown in its inwardly swung position located a given distance ahead of the web-guide roller 2 to duplicate the web vertically upwardly. The web-guide system as described to this point is already known in the art.

To bridge the gap constituting the vertical paper-web stretch between the outlet of the deflection roller 9 of the web swing 8 and the underside of the support roll 1, a lifting unit is provided.

The lifting unit comprises two tension strands 11 which can be wires and are wound on the windlass 10 and between the strands, parallel to the support roll axis, an elongated entraining member 12 which can be a rod or bar, tube or cable or the like.

The wires 11 forming the strands run vertically between the web-guide rolls 3 and 4 and are deflected in the region of the support roll 1 by a free-running compressible-surface pressing roller 13 of rubber, foam material or bristles.

The pressing roller 13 can be pressed against the support roll 1 by a cylinder 14.

At each of its ends, the pressing roller 13 is provided with a catch hook 15. Upon retraction of the roller 13, a fixed abutment or cam 16 engages between the catch hooks 15 to shift the entrainer bar 12 over the pressing roller 13 onto a guide sheet 20 on which the bar is held by the cable 11 until the windlass lowers the bar. To compensate for tension variations, the strands or wires 11 can have elastic segments shown as spring 17 integrated therein.

In the embodiment of FIG. 2, the ends of wires 11 are not free as is the case with the embodiment of FIGS. 1 and 3, but are guided over the entire paths of these strands.

At their lower ends each strand is fixed substantially at the level of the outlet deflection roller 9 of the web swing 8 on the part 1d of the roll-making machine. Change in the effective length of the hanging portion of the strands is accomplished through the use of an upwardly and downwardly movable roller 19 which rides in the loops of the wires 18 between the lower abutment points and the entraining bar 12.

In this embodiment, the catch hooks 15 and the guide sheet 20 are eliminated since the entrainer bar 12 is held in a fixed path between the cables 11 for all positions of this bar.

During the coiling of the web into rolls, i.e. when the lifting device is unneeded, the entrainer bar 12 can be permitted to remain in position between the guide rolls 3, 4 and the upper guide roll 4 can have grooves in which the wires 11 can remain without disruption of the paper path.

For lifting the paper web toward the support roll 1 and applying the leading end of the web thereto, the devices of the invention operate as follows:

a service person trims the leading end 7 of the paper to a width less than the length of the entrainer bar, and if desired, attaches additional pieces of paper or the like to stiffen the leading end of the web. The leading end is then formed with a crease and the web can be engaged between belts and fed into the region directly below the support roll 1.

To engage the crease in the paper web, the entraining bar 12 is initially lowered below the path of the web from the belt swing 8. As the web end is fed from the swing 8, a light curtain or other optical sensor triggers the drive 10a of the windlasses 10 into operation to raise the bar 12 and allow it to engage the crease in the paper end 7 and draw the web upwardly as the web is fed to the right.

Simultaneously, the pressing cylinder 14 urges the pressing roller 13 and the wires 11 passing therearound against the support roll 1. As the entraining bar 12 passes over this roller, the web is applied tot he underside of the roll 1 and is drawn thereagainst by suction so that further rotation of the support roll 1 will carry the web to the stations at which the strips of paper are rolled or coiled.

After passing over the roller 13, the bar 12 is engaged by the hooks 15 and at this moment the drive of the windlasses 10 is halted. The pressing roller 13 is now retracted form the support roll 1 to the position shown in dot-dash lines in FIG. 1 and during this movement the abutment 16 cams the bar 12 over the pressing roller 13 onto the guide sheet where it is held until the windlasses are rotated in the opposite sense. The guide sheet 20 ensures that upon this reverse rotation of the windlasses, the entraining bar 12 can be lowered between the separated blades 5 and 6.

While the bar 12 is held on the guide sheet 20 by the strands 11, the blades 5 and 6 are brought together to begin slitting the web and forming longitudinal strips therein for coiling in the usual manner.

In the use of the embodiment of FIG. 2, after the entraining bar 12 is passed over the roller 13 and the latter has been retracted from the support roll 1, the windlass can be halted. Reversal of the windlass can return the bar 12 to a position between the rollers 3 and 4. The blades 5 and 6 can be brought together to slit the paper web and the speed of the paper web through the system can then be accelerated to the normal speed.

To pickup a new paper-web end, the bar 12 is lowered past the open-blade arrangement 5, 6 until it lies below the leading end 7, whereupon the process is repeated.

We claim:

1. A method of lifting a leading end of a paper web onto the underside of a support roll for a paper-roll-making machine to which the leading end of the paper web is fed below the support roll, said method comprising the steps of:

(a) forming a crease in the leading end of the paper web;

(b) engaging an elongated generally horizontal entraining member from below in said crease;

(c) lifting said elongated entraining member with said crease engaged thereby tot he underside of the support roll, thereby drawing the leading end of the paper web to said underside of said support roll;

(d) pressing said elongated entraining member and said crease against said support roll with a pressing element by advancing said pressing element, over which said member can be guided, toward said support roll;

(e) retracting said pressing element from said support roll after said leading end has been engaged by said support roll;

(f) lowering said elongated entraining member from said pressing element; and (g) said elongated entraining member being raised and lowered by winding up and unwinding a pair of flexible strands affixed to said elongated entraining member by respective windlasses.

2. An apparatus for lifting a leading end of a paper web onto the underside of a support roll for a paper-roll-making machine to which the leading end of the paper web is fed below the support roll, said apparatus comprising:

an elongated generally horizontal entraining member engageable from below in a crease formed in said leading end of said paper web;

means for lifting said elongated entraining member with said crease engaged thereby to the underside of the support roll, thereby drawing the leading end of the paper web to said underside of said support roll; and a pressing element in the form of freely rotatable compressible roller advanceable toward and retractable from said underside of said support roll and positioned for pressing said elongated entraining member and said crease against said support roll upon advancing of said pressing element, over which said member can be guided, toward said support roll said means for lifting said elongated entraining member with said crease engaged thereby to the underside of the support roll including:

a pair of flexible strands engaging opposite ends of said member and upon which said member is suspended, and windlass means on which said strands are wound and which is provided with a drive for raising and lowering said member.

3. The apparatus defined in claim 2 wherein said member is a rod.

4. The apparatus defined in claim 2 wherein said member is a tube.

5. The apparatus defined in claim 2 wherein said member is a wire.

6. The apparatus defined in claim 2 wherein said member is suspended at free ends of said strand, catch hooks being provided at opposite ends of said roller for engaging said member after said member has been drawn over said roller.

7. The apparatus defined in claim 6, further comprising cam means effective upon retraction of said roller from said support roll to displace said member out of said catch hooks to permit lowering of said member.

8. The apparatus defined in claim 2 wherein lower ends of said strands are fastened to said machine and form loops below said member, a compensating roller engaging said loops and being moveable up an down as said member is raised and lowered by said windlass means.

9. The apparatus defined in claim 2 wherein said machine includes a longitudinal slitter for said web having respective blade means on opposite sides of said web, said blade means being separable to permit said member to pass therebetween.

10. The apparatus defined in claim 2 wherein said support roll is perforated and evacuated.

11. The apparatus defined in claim 10 wherein said strands are provided with elastic portions.

12. The apparatus defined in claim 2 wherein said roller is a brush.

13. The apparatus defined in claim 4 wherein said machine has a paper guide roll located directly below a region of the support roll against which said element presses said member.

* * * * *